US011204174B2

(12) United States Patent
Cowan et al.

(10) Patent No.: US 11,204,174 B2
(45) Date of Patent: Dec. 21, 2021

(54) CONFIGURABLE CONTROL SELECTORS

(71) Applicant: Midea Group Co., Ltd., Foshan (CN)

(72) Inventors: Richard W. Cowan, Louisville, KY (US); Daniel J. Trice, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 235 days.

(21) Appl. No.: 16/588,239

(22) Filed: Sep. 30, 2019

(65) Prior Publication Data

US 2021/0095857 A1 Apr. 1, 2021

(51) Int. Cl.
*F23N 1/00* (2006.01)
*F24C 3/12* (2006.01)

(52) U.S. Cl.
CPC ..... *F24C 3/126* (2013.01); *F23N 1/002* (2013.01); *F24C 3/124* (2013.01); *F23N 2235/18* (2020.01); *F23N 2237/02* (2020.01)

(58) Field of Classification Search
CPC ..... F24C 3/126; F24C 3/124; F23N 1/002; F23N 2235/18; F23N 2237/02
USPC ..... 126/39 E
See application file for complete search history.

(56) References Cited

U.S. PATENT DOCUMENTS 2,008,911 A 7/1935 Hodgkin et al.
3,476,315 A * 11/1969 Biggle ..... F24C 3/128 236/15 A
3,884,413 A 5/1975 Berquist
4,003,360 A 1/1977 Branson
5,241,463 A * 8/1993 Lee ..... F24C 3/126 700/90
5,310,110 A * 5/1994 Akamatsu ..... F24C 7/087 236/20 A
5,425,631 A * 6/1995 Krueger ..... F24C 3/126 431/6
5,575,638 A 11/1996 Witham et al.
5,813,320 A * 9/1998 Frasnetti ..... F24C 3/126 126/39 G
6,079,401 A 6/2000 Alvord et al.
8,033,279 B2 10/2011 Shaffer
9,068,752 B2 6/2015 Shaffer et al.
9,631,817 B2 4/2017 Cadima
2002/0190057 A1* 12/2002 Staebler ..... F24C 7/083 219/506
2004/0163639 A1 8/2004 Kijimoto
2006/0254573 A1 11/2006 Steinman et al.
2007/0113838 A1 5/2007 Czajka et al.
(Continued)

FOREIGN PATENT DOCUMENTS

CN 201129771 Y 10/2008
CN 101440973 A 5/2009
(Continued)

OTHER PUBLICATIONS

International Search Report and Written Opinion issued in Application No. PCT/CN2020/097872, dated Sep. 29, 2020.

*Primary Examiner* — Avinash A Savani
(74) *Attorney, Agent, or Firm* — Middleton Reutlinger

(57) ABSTRACT

A system for an appliance having a plurality of burners operated by a plurality of gas valves includes a plurality of selector buttons to assign a single control selector to a specified burner and a plurality of dedicated off buttons, assigned to the burners.

19 Claims, 3 Drawing Sheets

(56) References Cited

U.S. PATENT DOCUMENTS

| | | | | |
|---|---|---|---|---|
| 2007/0125356 | A1* | 6/2007 | Crnkovich | F24C 3/126 126/39 BA |
| 2007/0292810 | A1 | 12/2007 | Maiello et al. | |
| 2010/0200565 | A1 | 8/2010 | Leung et al. | |
| 2011/0146649 | A1* | 6/2011 | Brenner | F24C 3/126 126/42 |
| 2015/0034625 | A1* | 2/2015 | De Los Toyos Lopez | H05B 3/74 219/482 |
| 2017/0292712 | A1* | 10/2017 | Alexander | G06F 3/04883 |
| 2018/0017263 | A1 | 1/2018 | Roberts et al. | |
| 2018/0125296 | A1* | 5/2018 | Gafford | A47J 37/0713 |
| 2019/0373682 | A1* | 12/2019 | Lee | G03B 21/28 |

FOREIGN PATENT DOCUMENTS

| | | | |
|---|---|---|---|
| CN | 204853576 | U | 12/2015 |
| CN | 205560882 | U | 9/2016 |
| CN | 207438655 | U | 6/2018 |
| WO | 2000063620 | A1 | 10/2000 |

* cited by examiner

CONFIGURABLE CONTROL SELECTORS

BACKGROUND OF THE INVENTION

In appliance manufacturing industries generally, and specifically in the range or cooking appliance manufacturing industries, appliances such as cooktops or ranges have a variety of control or selector knobs for adjusting and controlling the amount of heat supplied to the various appliance burners or heating elements. Typically, an individual knob is assigned to an individual burner. However, "digital" gas appliance systems are becoming more common. A digital gas system for a gas range or cooktop employs electromechanical valves that aren't necessarily even mounted proximate the knobs that operate these valves. Instead, the control knobs are secured to a resolver or potentiometer that then supplies a signal to the gas valves to open and close them, thereby controlling the burner or oven temperature.

In most gas cooking appliances each burner or heating element is operated by a gas valve that is operatively coupled to a dedicated control knob to control the heat being applied in cooking. This system of operation obviously requires a large number of control knobs and selectors to operate the various burners on the appliance. In the case of digital valves the knobs or selectors can be positioned anywhere on the appliance, since they need not be mounted with the valves they are controlling. Accordingly, since control knobs can be placed anywhere and need not be physically connected to the valves they are controlling it is apparent that the number of control knobs or selectors utilized can be smaller than the number of valves being controlled.

From the foregoing, there is no need to have individual control selectors for each digital valve in an appliance. An appliance design having a reduced number of control selectors is therefore possible, thereby reducing attendant costs and simplifying the user interface to the appliance, as well as providing certain aesthetic improvements to the appliance without hampering the ability to use the appliance.

SUMMARY OF THE INVENTION

The present disclosure is related to systems and apparatus for providing customized or configurable control selectors for an appliance. The system described herein may utilize a single knob or selector assembly mounted in the appliance that may be selectively assigned to different burners or heating elements of the appliance. In some aspects and embodiments the system described may include a knob or selector assembly that includes a burner status display that depicts in graphical terms the status of the burner that is currently selected.

The system in accordance with some aspects may be configured by a user utilizing an operator interface or other knob selector interface to define or select a burner to be operated by the single control selector. Additionally, the control knob or selector may be rapidly switched from control of one burner to another, thereby providing safe operation of the appliance controls and providing a system for safely operating the gas valves thereof with a minimum of operator input.

In various embodiments, the system disclosed herein provides a configurable knob control that, when assigned to a burner, provides a user defined operation to operate an appliance gas valve to an selected open position. In other aspects and embodiments a knob or selector mounted in a convenient location on an appliance may be configurable via a user interface to operate a plurality of valves or concomitant burners, or alternatively a remotely or locally located selector button or switch may be provided for assigning the selector or control knob to actuate a valve.

In some aspects and embodiments each burner or heating element of an appliance may include a selector button or interface as well as an off button and/or a status display for operation. In other aspects and embodiments a plurality of selector buttons may be assigned to a plurality of burners while a single configurable control selector may be employed to set a temperature or heat setting for a selected burner.

In some embodiments a single selector or control knob may include an integral switch that includes an ignition function so that a two-step ignition process is provided to ignite a burner, thereby enhancing operating safety.

In various aspects and embodiments the system described herein may include a processor having a plurality of inputs and outputs that are operatively coupled to various components of an appliance, including a user interface and a pushbutton, switch or touch sensor. In some embodiments processor may be coupled with a user interface that is suitably programmed to provide a configurable control selector that may be initiated by a user to configure the control.

As used herein for purposes of the present disclosure, the term "appliance" should be understood to be generally synonymous with and include any device that consumes electrical power and can be connected to an electrical circuit or battery, for example one used in a residential or commercial setting to accomplish work. The appliances referred to herein may include a plurality of electrically operated components powered by the circuit, the components operable by manipulation of control knobs or selectors. The appliances referred to herein may also include a gas supply or source and one or more gas valves for supplying gas to a burner or heating element. The appliance gas valves may be controlled by a selector or knob, either directly or indirectly, and the appliance may also include a processor or processors that operate, control and monitor the appliance and the various components and functions thereof referred to throughout this specification.

The terms "knob" or "selector" are used herein generally to describe various devices that are operatively coupled to functional components of the appliance and which may typically, but not exclusively, be operated by hand by a user. Typical control knobs and selectors include but are not limited to gas and electric burner controls, gas and electric oven controls, lighting and timing controls, start and stop controls, switches, sliders, pushbuttons, wheels, levers, and various other functional controls associated with an appliance. "Selector" may also be used to refer to a programmed button selection on a touch-screen or similar operator interface.

The term "controller" or "processor" is used herein generally to describe various apparatus relating to the operation of the system and the appliances referred to herein. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), programmable logic controllers (PLCs), and field-programmable gate arrays (FPGAs).

A processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "Internet" or synonymously "Internet of things" refers to the global computer network providing a variety of information and communication facilities, consisting of interconnected networks using standardized communication protocols. The appliances, controllers and processors referred to herein may be operatively connected to the Internet.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. The drawings are not necessarily to scale. Emphasis is instead generally placed upon illustrating the principles of the disclosure, wherein.

DETAILED DESCRIPTION OF THE INVENTION

Figure 1:
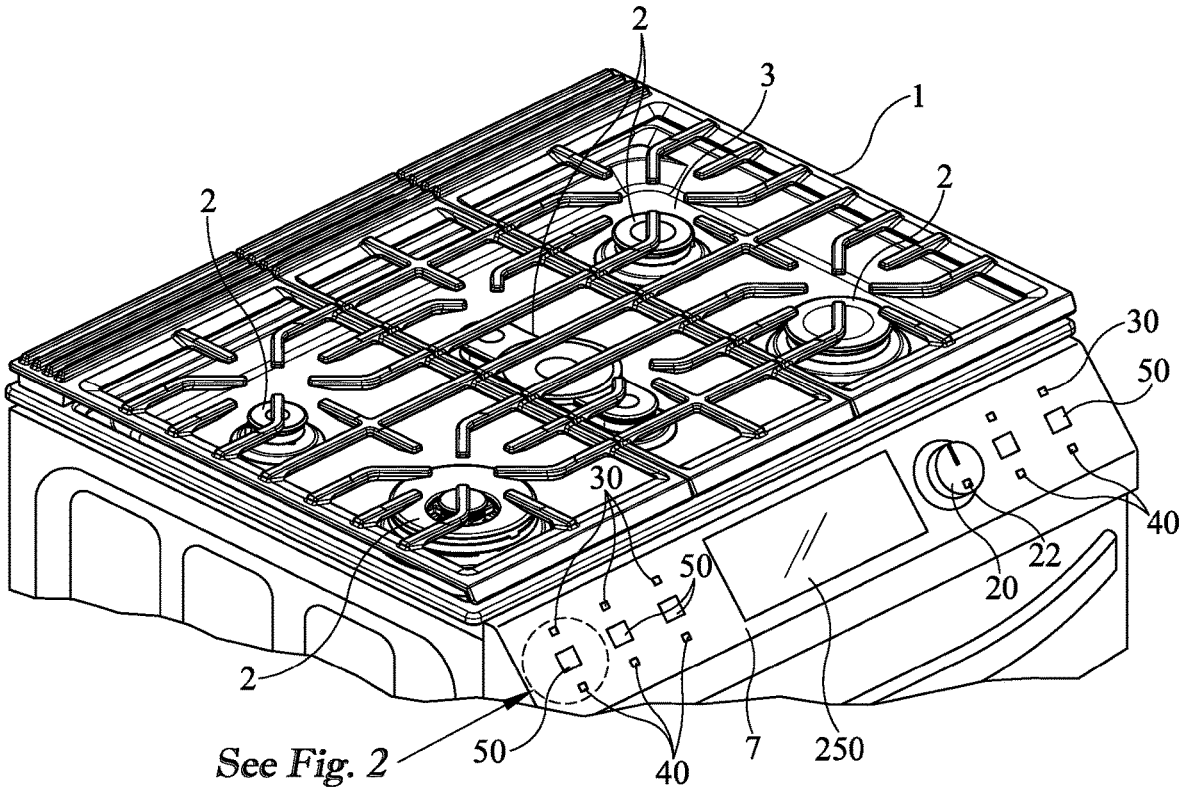
FIG. 1 is a perspective view of a gas appliance having a plurality of burners in accordance with various embodiments.
Figure 2:
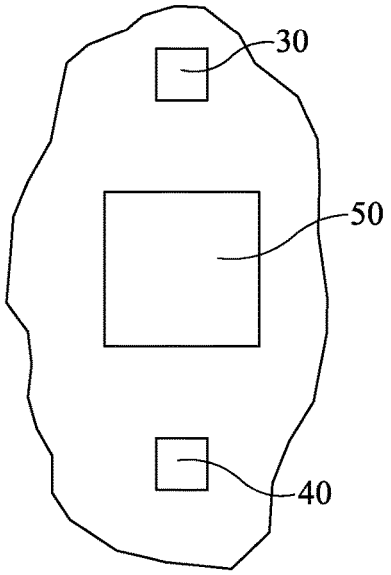
FIG. 2 is a detail view of a burner selector system that may be used in conjunction with an appliance in accordance with various embodiments.

Referring to drawing FIGS. 1-4, and in accordance with various aspects and embodiments of the invention, a system 10 for an appliance 1 having a plurality of burners 2, each having a digital gas control valve 6 for supplying gas thereto is described. In one non-limiting exemplary embodiment for purposes of illustration in this specification, appliance 1 may be a conventional gas stove 1, (or equivalently a cooktop and oven combination). Stove 1 may include a single configurable control knob or selector 20 to adjust the flow of gas to a plurality of gas valves 4, and thus the heat output of a plurality of cooktop burners 2, as well as a plurality of oven heating elements or burners (not shown).

Figure 4:
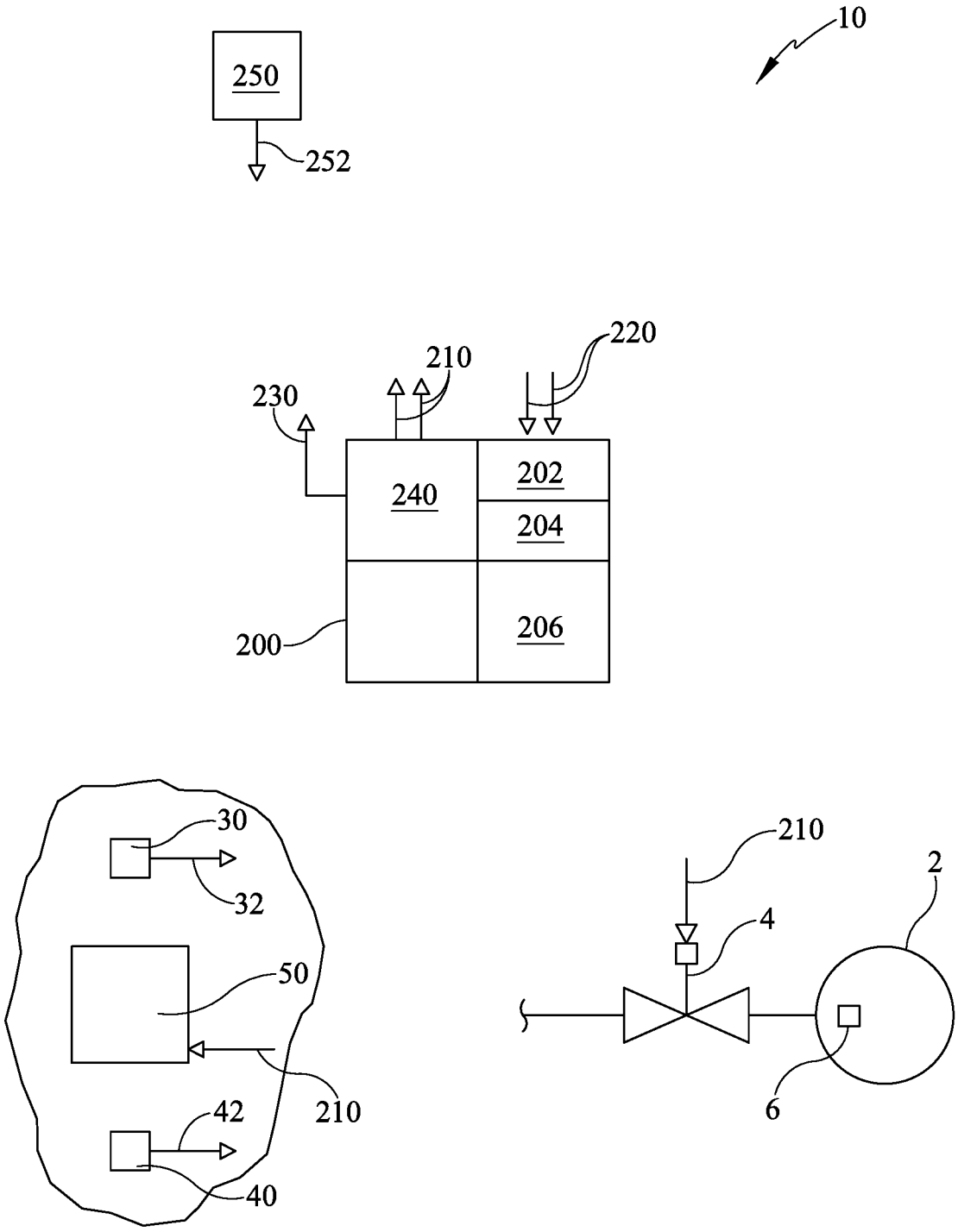
FIG. 4 is a block diagram of a control system in accordance with various embodiments.

In various embodiments the appliance 1 in which system 10 is implemented may include a controller 200 integral to appliance 1 that operates appliance 1 and implements various embodiments and aspects of system 10 as described herein. FIG. 4 illustrates an exemplary appliance 1 hardware environment for implementing system 10 for configurable control selector 20 operation. The system 10 may include a controller 200, a processor or processors 202 and concomitant memory 204. Appliance 1 controller 200 may further comprise a plurality of signal outputs 210 and signal inputs 220 that may be operatively connected to a plurality of appliance 1 components to monitor and direct system 10 operation. Furthermore, in some embodiments controller 200 may include a wireless or hard-wired communications interface 230 that enables controller 200 to communicate with external devices or communications networks such as the internet, that may be integrated into system 10.

Additionally, controller 200 may be equipped with an operator or user interface 250 to provide audible or visual feedback to a user as well as provide a user the ability to provide instructions or commands to controller 200. Exemplary but non-limiting user interfaces 250 that may be employed include a mouse, keypads, touch-screens, keyboards, switches and/or touch pads. Any user interface may be employed for use in the invention without departing from the scope thereof. It will be understood that FIG. 2 constitutes, in some respects, an abstraction and that the actual organization of the components of appliance 1 and controller 200 may be more complex than illustrated.

The processor 202 may be any hardware device capable of executing instructions stored in memory 204 or data storage 206 or otherwise processing data. As such, the processor may include a microprocessor, field programmable gate array (FPGA), application-specific integrated circuit (ASIC), or other similar devices.

The memory 204 may include various memories such as, for example L1, L2, or L3 cache or system memory. As such, the memory 204 may include static random access memory (SRAM), dynamic RAM (DRAM), flash memory, read only memory (ROM), or other similar memory devices. It will be apparent that, in embodiments where the processor includes one or more ASICs (or other processing devices) that implement one or more of the functions described herein in hardware, the software described as corresponding to such functionality in other embodiments may be omitted.

The user interface 250 may include one or more devices for enabling communication with a user such as an administrator. For example, the user interface 250 may include a display, a mouse, and a keyboard for receiving user commands. In some embodiments, the user interface 250 may include a command line interface or graphical user interface that may be presented to a remote terminal via the communication interface 230.

The communication interface 230 may include one or more devices for enabling communication with other hardware devices. For example, the communication interface 230 may include a network interface card (NIC) configured to communicate according to the Ethernet protocol. Additionally, the communication interface 230 may implement a TCP/IP stack for communication according to the TCP/IP protocols. Various alternative or additional hardware or configurations for the communication interface 230 will be apparent.

The storage 206 may include one or more machine-readable storage media such as read-only memory (ROM), random-access memory (RAM), magnetic disk storage media, optical storage media, flash-memory devices, or similar storage media. In various embodiments, the storage 206 may store instructions for execution by the processor 202 or data upon with the processor 202 may operate. For example, the storage 206 may store a base operating system for controlling various basic operations of the hardware. Other instruction sets may also be stored in storage 206 for executing various functions of system 10, in accordance with the embodiments detailed below.

It will be apparent that various information described as stored in the storage 206 may be additionally or alternatively stored in the memory 204. In this respect, the memory 204 may also be considered to constitute a "storage device" and the storage 206 may be considered a "memory." Various other arrangements will be apparent. Further, the memory 204 and storage 206 may both be considered to be "non-transitory machine-readable media." As used herein, the term "non-transitory" will be understood to exclude transitory signals but to include all forms of storage, including both volatile and non-volatile memories.

While the controller 200 is shown as including one of each described component, the various components may be duplicated in various embodiments. For example, the processor 202 may include multiple microprocessors that are configured to independently execute the methods described herein or are configured to perform steps or subroutines of the methods described herein such that the multiple processors cooperate to achieve the functionality described herein.

Referring again to FIGS. 1-3, and in accordance with some exemplary embodiments, a system 10 for implementing a configurable control selector 20 for an appliance 1 having a plurality of burners 2 includes a single control selector knob 20 (alternatively control knob 20), that is utilized to operate a plurality of digital gas valves 4 of appliance 1. It should be understood that any appliance 1 or other device that utilizes a control or selector knob 20 wherein it would be desirable to implement a configurable control selector 20 may form a part of the operating environment of system 10 without departing from the scope of the invention.

In some aspects and embodiments control knob 20 is turned or rotated clockwise to supply additional gas (and therefore heat) to a selected burner 2, and conversely turned counter-clockwise to reduce the amount of gas (and therefore heat) to a selected burner 2. In some aspects and embodiments control knob 20 may be rotated in a first direction to increase the open position of valve 4 and rotated in the opposite direction to reduce the open position of valve 4.

In some aspects of the invention control knob 20 may be mounted to or secured to an encoder, potentiometer, or equivalent signal generator that provides and is operatively coupled to an input 220 to controller 200 representative of a desired gas valve 4 position and/or burner 2 heat level when control knob 20 is rotated, whereby controller 200 provides a corresponding output 210 to control gas valve 4 that is representative of a desired burner 2 power level.

FIG. 1 depicts an exemplary but non-limiting system 10 having controls on a cooktop 3 which includes burners 2. Appliance 1 may include a front panel or other mounting surface 7 on which various controls of appliance 1 are mounted. Each burner 2 includes a selector button 30, an "off" button 40, and a status display 50. It should be understood that the term "burner" 2 may include an oven temperature control. It should be further understood that each burner 2 is operatively coupled to a digital gas valve 4 that is in turn operatively coupled to an input 220 and/or output 210 of controller 200, thereby providing for control of valve 4 and burner 2.

In some aspects and embodiments selector buttons 30 may be any type of switch or button having an output 32 operatively coupled to a controller 200 input 220, whereby output 32 provides an input 220 to controller 200 that indicates that the burner 2 associated with that specific selector switch is being controlled by control knob 20. In some aspects selector switch 30 may be an icon suitably programmed on a touch screen or the equivalent. When a specified selector switch 30 is depressed or otherwise activated, processor 200 interprets the corresponding input 220 as "assigning" control knob 20 to the corresponding burner 2, whereby processor 200 supplies an output 210 to control that burner 2 based on the control knob 20 position.

In some embodiments off button 40 may be any type of switch or button having an output 42 operatively coupled to a controller 200 input 220, whereby output 42 provides an input 220 to controller 200 that indicates that the burner 2 and valve 4 associated with that specific off button 40 should be turned to the off position. In some aspects off button 40 may be an icon suitably programmed on a touch screen or the equivalent. When a specified off button 40 is depressed or otherwise activated, processor 200 interprets the corresponding input 220 as a signal to close gas valve 4 associated with burner 2.

In accordance with some aspects and embodiments each burner 2 includes a status display 50, that may comprise a digital electronic display, LED indicators, or an LED screen or the equivalent. Status displays 50 are operatively coupled to an output or outputs 210 of processor 200 that enable displays to depict the operational status of each burner. For example, status displays may depict an "on" status, an "off" status, a burner power level, or one of a plurality of "mode" status indications as will be detailed further herein below.

In some aspects and embodiments, in operation burners 2 can be ignited by activating or pushing the selector button 30 assigned to that specific burner 2, thereby assigning control knob 20 to that burner 2. The configurable control knob 20 is then turned either clockwise or counterclockwise to open the concomitant gas valve 4 for that burner 2. Burner 2 then ignites and control knob 20 may be rotated to adjust the power level of burner 2 which is then displayed on the status display 50 associated with that burner 2, or on the main user interface 250. If a user wishes to operate another burner 2, they simply activate selector button 30 for that burner 2 thereby assigning control knob 20 to the burner 2 selected. In some embodiments, processor 200 assigns control selector 20 to the most recent or last selector button 30 output 32 that is received as an input 220 to processor 200, thereby assuring a user that as soon as selector button 30 is activated, control selector 20 is assigned to the specified burner 2.

As is readily apparent, system 10 provides a single control knob that can then be used to control all burners 2, thereby providing for ease of burner operation 2 as well as an uncluttered appearance of appliance 1. Additionally, off buttons 40 remain active for each burner at all times, thereby providing a quick and efficient system 10 for turning off burners 2. Status indicator 50 will accordingly depict when a specified burner 2 is on or off, based on the burner 2 valve 4 status as determined by processor 200.

In some aspects and embodiments user interface 250 may display all burner 2 status indicators in a central location, for example on mounting surface 7 of cooktop 1. In these embodiments, each burner 2 status may be indicated separately by, for example, an iconographic indication on user interface 250. In these embodiments individual burner 2 status indicators 50 may be omitted, as all burner 2 status can be readily displayed on operator interface 250.

In some aspects and embodiments control selector 20 may include an integral switch 22, for example a sensor or a mechanical or electro-mechanical switch that provides an input 220 to controller 200 that indicates that a selected burner 2 is to be ignited. In some exemplary embodiments and aspects switch 22 may be a touch element such as a capacitive touch sensor. In some additional embodiments switch 22 may be a programmed button or selection on operator interface 250 such that a user must select or touch the user interface 250 in the prescribed method to activate gas valve 4 for a specified burner. In these embodiments a burner 2 selector button 30 is activated, thereby assigning control selector 20 to that burner 2. Control selector 20 is then rotated while touching or activating switch 22 to indicate to process 200 that burner 2 should be ignited, as detailed herein above. This embodiment of the invention provides for a two-step process for burner 2 ignition, thereby adding a measure of safety to the ignition process. Control selector 20 can then be rotated to set burner 2 heat level.

Figure 3:
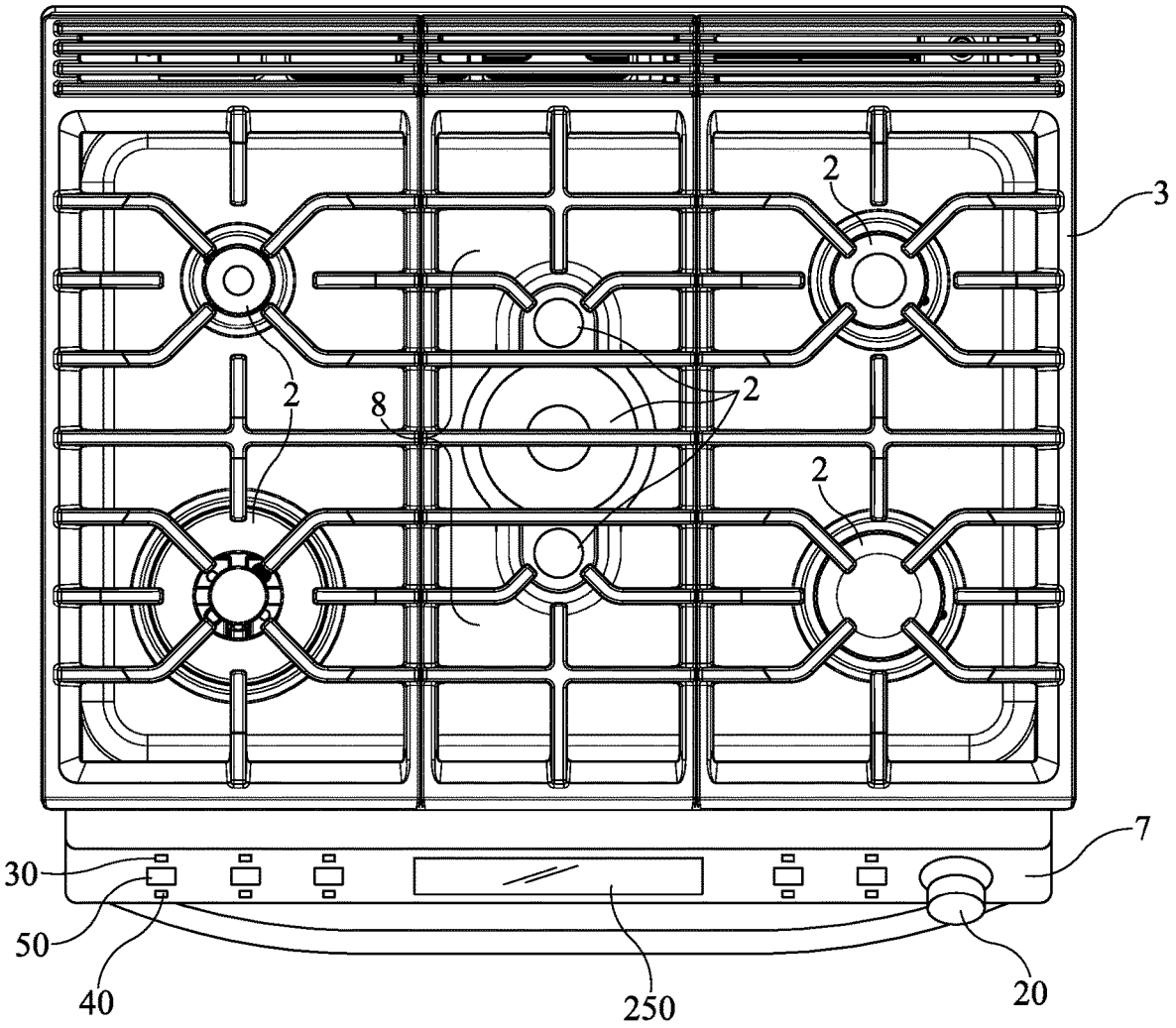
FIG. 3 is a top view of a cooktop in accordance with various embodiments.

In some aspects and embodiments system 10 provides an apparatus to configure control knob 20 to perform a plurality of functions on a customized burner 2 group. In some embodiments appliance 1 may have a dedicated control knob for 20 each specified burner 2 group. Alternatively, cooktop 1 may just include a single selector knob 20 for all burner 2 control functions. FIG. 3 depicts a cooktop 1 with a custom burner group 8 in the center of cooktop 1, comprised of three burners 2 in a wok or griddle configuration. Burner group 8 may be operated in a plurality of different configurable modes using only a single control knob 20.

In some embodiments, burner group 8 may be operated in a first mode, for example a single burner mode, by utilizing either operator interface 250 or a selector button 30 to select only the central (or center) burner 2, for example a wok-style burner, and thereby assigning it to control knob 20. In a second operational mode, a griddle mode, a selector button 30 or operator interface 250 selection or a "griddle mode" icon, assigns control knob 20 to operate all three central burners 2 of burner group 8 to heat a griddle plate or the like placed on cooktop 1. In some embodiments the heat output or valve 4 positions may be are predetermined by processor 200 to equalize the temperature distribution from the front burner 2 to the back burner 2 of burner group 8, thereby providing even heat across the burner group and a griddle plate. In some embodiments valve 4 assigned to the center or wok burner 2 may be operated to cycle off and on based on a predetermined duty cycle provided by processor 200 instructions, thereby preventing overheating the center of the griddle. In these aspects and embodiments controller 200 is provided with suitable instructions whereby output 210 to center or wok burner 2 is cycled in a predetermined fashion while in to provide a preset amount of heat to wok burner 2 when system 10 is in griddle mode.

In a yet further operational mode, for example a multi-burner mode, a selector button 30 or operator interface 250 selection the center burner 2 is disabled completely and control knob 20 is assigned to operate individual front and rear burners 2 of burner group 8 independently but simultaneously, thereby providing even heat across two burners 2.

In accordance with some embodiments, in operation, operator interface 250 may be provided with suitable programming instructions to depict or represent a selector button 30 for each burner 2 and/or burner group 8 that operates just as a mechanical switch would. When operator interface 250 switch 30 is selected for a given burner 2 or group 8 and control knob 20 has been turned, processor 200 provides an output 220 to valve 4 and ignitor 6 to operate the selected burner 2.

While a variety of inventive embodiments have been described and illustrated herein, those of ordinary skill in the art will understand that a variety of other methods, systems, and/or structures for performing the function and/or obtaining the results, and/or one or more of the advantages described herein are possible, and further understand that each of such variations and/or modifications is within the scope of the inventive embodiments described herein. Those skilled in the art will understand that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or"

as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A system for an appliance having a plurality of burners operated by a plurality of gas valves comprising:

a plurality of selector buttons, wherein each selector button among the plurality of selector buttons is assigned to a specified one of the plurality of burners;

a plurality of off buttons, wherein each off button among the plurality of off buttons is assigned to a specified one of the plurality of burners;

a control selector having an output representative of a valve position and configured to be selectively assigned to any of the plurality of burners, wherein the control selector is assigned to a specified burner of the plurality of burners when the selector button assigned to the specified burner is activated; and a processor and concomitant data memory, wherein the processor is coupled to the plurality of selector buttons, the plurality of off buttons, the control selector, and the plurality of valves;

wherein the processor is configured to accept a most recent selector button input to assign the control selector to the burner to which the most recent selector button is assigned; and wherein the processor is configured to control a valve position of a valve among the plurality of valves that operates the burner to which the most recent selector button is assigned responsive to user input received from the control selector.

2. The system of claim 1 wherein the plurality of valves are digital gas valves.

3. The system of claim 1 comprising:

a status indicator associated with each of the burners for displaying a burner on, burner off, and/or a burner power level status.

4. The system of claim 1 comprising:

a user interface operatively coupled to the processor, wherein the user interface includes a plurality of status indicators respectively associated with the plurality of burners.

5. The system of claim 4 wherein the user interface includes a touch-screen, and wherein the plurality of selector buttons are displayed on the touch-screen.

6. The system of claim 1 wherein the control selector comprises:

a rotatable knob having a button mounted on a front portion thereof for igniting the specified burner.

7. The system of claim 6 wherein the rotatable knob is rotatable to a predetermined position representative of a desired output of the specified burner prior to ignition of the specified burner.

8. The system of claim 1 wherein each burner is turned off by operation of the off button assigned thereto.

9. The system of claim 1 wherein the plurality of burners includes a burner group including multiple burners from among the plurality of burners, the burner group configured to operate in a plurality of selectable operational modes.

10. The system of claim 9 wherein the burner group comprises a three burner arrangement having a center wok burner and a pair of griddle burners proximate thereto for wok and griddle operation, and wherein the plurality of selectable operational modes include a wok mode and a griddle mode.

11. The system of claim 10 wherein when the griddle mode is selected the center wok burner is cycled at predetermined intervals to provide even heat to the burner group.

12. A system for an appliance having a plurality of burners operated by a plurality of digital gas valves comprising:

a plurality of selector buttons, wherein each selector button among the plurality of selector buttons is assigned to a specified one of the plurality of burners;

a plurality of off buttons, wherein each off button among the plurality of off buttons is assigned to a specified one of the plurality of burners;

a plurality of status indicators, each status indicator associated with a specified one of the plurality of burners for displaying a burner on, burner off, and/or a burner power level status;

a control selector comprising a single rotatable knob and having an output representative of a valve position, the control selector configured to be selectively assigned to any of the plurality of burners, wherein the control selector is assigned to a specified burner of the plurality of burners when the selector button assigned to the specified burner is activated; and a processor and concomitant data memory, wherein the processor is coupled to the plurality of selector buttons, the plurality of off buttons, the plurality of status indicators, the control selector, and the plurality of digital gas valves;

wherein the processor is configured to accept a most recent selector button input to assign the control selector to the burner to which the most recent selector button is assigned; and wherein the processor is configured to control a valve position of a digital gas valve among the plurality of digital gas valves that operates the burner to which the most recent selector button is assigned responsive to user input received from the control selector.

13. The system of claim 12 comprising:

a user interface operatively coupled to the processor, the user interface having a display and a plurality of selectable icons displayed thereon.

14. The system of claim 13 comprising:

at least one burner group consisting of multiple burners from among the plurality of burners; and a plurality of operational mode selections provided on the user interface;

wherein the processor is configured to select from among a plurality of operational modes for the burner group in response to activation of one of the plurality of operational mode selections provided on the user interface.

15. The system of claim 14 wherein the plurality of operational modes comprise:

a multi-burner mode wherein at least a subset of the multiple burners in the burner group are individually controllable;

a wok mode wherein a center burner in the burner group is controlled by the control selector while other burners in the burner group are deactivated; and a griddle mode wherein the multiple burners in the burner group are controlled by the control selector to provide an even temperature across the burner group.

16. The system of claim 1, wherein the control selector comprises a single rotatable knob.

17. An appliance, comprising:

a cooktop including a plurality of gas burners;

a plurality of digital gas valves, wherein each digital gas valve among the plurality of gas valves is assigned to a respective gas burner among the plurality of gas burners to control a flow of gas to the respective gas burner;

a plurality of selector controls, wherein each selector control among the plurality of selector controls is assigned to a respective gas burner among the plurality of gas burners;

a plurality of off controls, wherein each off control among the plurality of off controls is assigned to a respective gas burner among the plurality of gas burners;

a plurality of status displays, wherein each status display among the plurality of status displays is assigned to a respective gas burner among the plurality of gas burners;

a variable control selector having an output representative of a valve position and configured to be selectively assigned to any of the plurality of gas burners; and a controller coupled to each of the plurality of digital gas valves, the plurality of selector controls, the plurality of off controls, the plurality of status displays and the variable control selector, wherein the controller is configured to:

assign the variable control selector to a specified gas burner among the plurality of gas burners in response to user activation of the selector control among the plurality of selector controls that is assigned to the specified gas burner;

control a valve position of the respective digital gas valve for the specified gas burner in response to user activation of the variable control selector while the variable control selector is assigned to the specified gas burner;

control the valve position of the respective digital gas valve for the specified gas burner to deactivate the specified gas burner in response to user activation of the off control among the plurality of off controls that is assigned to the specified gas burner; and display a status of each of the plurality of gas burners on the respective status display assigned thereto.

18. The appliance of claim 17, wherein the controller is configured to ignite the specified burner in response to user activation of the selector control followed by user activation of the variable control selector.

19. The appliance of claim 17, wherein the variable control selector includes an ignition control disposed thereon, and wherein the controller is configured to ignite the specified burner in response to user activation of the selector control followed by user activation of the ignition control.

* * * * *